US010954628B2

(12) United States Patent
Cobanoglu et al.

(10) Patent No.: US 10,954,628 B2
(45) **Date of Patent: *Mar. 23, 2021**

(54) PROCESS OF TEXTILE DYEING AND DYED TEXTILES

(71) Applicant: Sanko Tekstil Isletmeleri San. Ve Tic. A.S., Inegol-Bursa (TR)

(72) Inventors: Ozgur Cobanoglu, Inegol-Bursa (TR); Jitka Eryilmaz, Inegol-Bursa (TR); Deniz Iyidogan, Inegol-Bursa (TR); Gokhan Kaplan, Inegol-Bursa (TR); Leyla Zengi, Inegol-Bursa (TR); Aybige Akdag, Inegol-Bursa (TR); Agamirze Hamitbeyli, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 0 days.

This patent is subject to a terminal disclaimer.

(21) Appl. No.: 16/583,630

(22) Filed: Sep. 26, 2019

(65) Prior Publication Data

US 2020/0102700 A1 Apr. 2, 2020

(30) Foreign Application Priority Data

Sep. 27, 2018 (EP) ..... 18197202

(51) Int. Cl.

| | |
|---|---|
| ***D06C 29/00*** | (2006.01) |
| ***D06P 1/673*** | (2006.01) |
| ***D06P 1/22*** | (2006.01) |
| ***D06P 5/13*** | (2006.01) |

(52) U.S. Cl.

CPC ..... *D06P 1/673* (2013.01); *D06P 1/228* (2013.01); *D06P 5/138* (2013.01)

(58) Field of Classification Search

CPC .. D06C 29/00; D06M 15/564; D06M 15/507; D06M 11/74

USPC ..... 8/115.6

See application file for complete search history.

(56) References Cited

U.S. PATENT DOCUMENTS

| | | | | |
|---|---|---|---|---|
| 2003/0106160 | A1 | 6/2003 | Sun et al. | |
| 2008/0155764 | A1 | 7/2008 | Janssen et al. | |
| 2009/0155589 | A1* | 6/2009 | Aikyou | C01B 32/05 428/402 |

FOREIGN PATENT DOCUMENTS

| | | |
|---|---|---|
| CN | 106120382 | 11/2016 |
| EP | 2322710 | 5/2011 |
| JP | H01162881 | 6/1989 |

OTHER PUBLICATIONS

European Search Report issued by the EPO dated Nov. 30, 2018 for EP priority application No. 18197202.7.

Office Action issued by the EPO dated Oct. 28, 2020 for EP priority application No. 18197202.7.

International search report and written opinion issued by the EPO dated Nov. 25, 2019 for corresponding International application PCT/EP2019/075878.

Database WPI Thomson Scientific, London GB, AN 2016-728839, XP002786705.

* cited by examiner

*Primary Examiner* — Eisa B Elhilo

(74) *Attorney, Agent, or Firm* — Silvia Salvadori

(57) ABSTRACT

A textile is dyed by treating the textile with a composition containing 2D nano and/or microparticles of carbon and by dyeing the textile with a dye that is different from said carbon particles.

16 Claims, 3 Drawing Sheets

PROCESS OF TEXTILE DYEING AND DYED TEXTILES

This application is a U.S. Non-provisional application which claims priority to and the benefit of European Patent Application EP18197202.7 filed on 27 Sep. 2018, the content of which is incorporated herein by reference in its entirety.

The present invention relates to a process of dyeing textiles and to the textiles dyed with such process. In greater detail, the invention relates to a method of producing modified textiles which include carbon particles, namely carbon microparticles and/or carbon nanoparticles.

Dyeing is a known process of applying a colour to a textile; the textile may be fibers, yarns, fabrics or garments. In the field of textile dyeing, it is known to carry out a "ring-dyeing" process according to which dye is concentrated on the outer thickness of a yarn. Ring-dyeing is particularly useful in dyeing of yarns for denim and other casual fabrics that have to show a "worn" or "washed-out" appearance in the final garment.

Known dyeing processes may be long and use several steps and a lot of water; an example of such processes is indigo dyeing, which may require several steps in order to obtain the required colour shade. Additionally, known dyeing processes make use of high volumes of water. To reduce the number of steps in an indigo dyeing process it was proposed to pre-treat the fabric with a dye to provide a basis or undercoat for the subsequent indigo process. The "undercoat" should provide darker shades of indigo with fewer dyeing steps. These known "undercoating" methods, however, result in a change of the spectral response of the desired color.

It has been proposed to use nanoparticle dyes to improve the dyeing process in polymeric synthetic yarns. US2003/0106160 discloses a process for dyeing synthetic textiles by using nanoparticles of the dye to be used; the dye nanoparticles diffuse in the polymers of the textile fibers and are embedded into a textile, namely into yarns. Preferably, at least about 60% to about 70% of the embedded nanoparticles which have diffused into the polymer of the fibers are present just below the surface of the polymer.

The nanoparticles in U.S. Pat. No. '160 can be organic or inorganic nanoparticles. The nanoparticles suitable for use are metal oxides, nanosized metals, inorganic pigments, organic pigments, insoluble polymers, and any solid materials that can be physically or chemically processed into nanosize particles. In one preferred embodiment, the nanoparticle is carbon black. The dimensions of the nanoparticles are claimed to be 1-100 nm; small nanoparticles of 8 nm give better results than greater ones. Suitable and preferred nanoparticles are e.g. nanosized particles, such as Ag, Cu, Fe, glass, Au and Pt. U.S. Pat. No. '160 is silent about the 2D particles imparting special optical effects to the dyed fabric.

US2008/155764, discloses processes for dyeing textile webs either woven or non-woven. The dye is a solvent-based dye that comprises at least one component which may be selected from one or more of carbon black, graphite, alumina, titanium, and other possible metals as additional components, including mixed oxides, such as magnetite, nickel oxide and the like. This invention is also silent about an undercoating for indigo and/or indigo derivatives.

Therefore, there is a need for a new textile dyeing process that could solve or mitigate the above discussed problems. The new process should also simplify dyeing processes to obtain a ring-dyed textile.

It is an aim of the present invention to solve the above problems and to provide a process for dyeing textiles that is easier and more economic to implement than known processes, and that is also suitable to provide ring-dyed yarns.

Said aim is reached by the present invention, which provides a process of dyeing textiles according to claim 1. It is a further object of the invention a textile according to claim 9; another object of the invention is a garment according to claim 13; a further object of the invention is a composition for dyeing a textile according to claim 15, and also object of the invention is the use according to claim 16.

In an embodiment, the process comprises the steps of preparing a composition containing carbon particles, namely carbon nanoparticles and/or carbon microparticles. At least some of the carbon particles applied with said composition to textiles are "2D" particles, i.e. lamellar particles in the shape of "nano- and/or micro-sheets" or "nano- and/or micro-surfaces". In greater detail, a carbon particle useful for the invention is a 2D nanoparticle and/or 2D microparticle having dimensions of 0.01 to 80 microns, preferably of 0.1 to 20.0 microns, more preferably of 0.5 to 2 microns. Suitable 2D nanoparticles and/or 2D microparticles are 2D, or flake-shaped, particles preferably selected from graphene flakes, graphite flakes and mixtures thereof. Size measurements of carbon particles may be done with an optical microscope and atomic force microscope (AFM) or by Malvern Dynamic Light Scattering using a wet method (particles were suspended in wet medium including an emulsifier). Techniques for particle measurement are common general knowledge, e.g. as summarized in "A basic guide to particle characterization" 2015, Malvern Instruments Limited, available online.

With the wordings "2D nanoparticles" and "2D microparticles" it is here meant nano- and microparticles in which the thickness of the particle is few nanometers and the length of the major axis is in range of tens to hundreds of nanometers or a few microns; suitable 2D particles are $\pi$-$\pi$ stacked multilayer graphene or graphite particles having dimensions as above discussed.

With the wording "undercoat" or "undercoating" this specification defines a coating, or coating process, using carbon particles, particularly 2D carbon particles that is used in a dyeing process before the final colour is applied to the textile.

It was found that carbon nanoparticles or microparticles, in the form of flakes, having the above specified dimensions, can adhere to the fibers of the yarns of a textile, at least in the outer layer of the yarn, on a yarn alone, in a rope or in a fabric, so as to provide a layer of carbon particles at least in the external thickness of the yarn, i.e. in a ring on the surface and part of the interior of a yarn. This layer acts as an undercoating, i.e. as a basis, or foundation, onto which an additional dye can be deposited. Indigo is a preferred additional dye.

In a possible embodiment, the composition further comprises other carbon particles (i.e. carbon particles other than 2D nanoparticles and/or 2D microparticles as described above), such as amorphous carbon nanoparticles, to enhance the effect provided by the undercoating 2D carbon particles. For example, such non-2D carbon nanoparticles are nanoparticles of amorphous carbon. Such nanoparticles of amorphous carbon preferably having dimensions in the range of 1 nm to 1000 nm, more preferably 1 to 800 nm, even more preferably 10 to 200 nm as measured by Malvern Dynamic Light Scattering using a wet method (particles were suspended in wet medium including an emulsifier).

According to an embodiment of the invention, the textile is treated at least once, preferably more than once, with the composition of carbon particles to provide darker shades; preferably, this is carried out with a dip and dry process.

The invention also relates to the textiles obtained with the above mentioned process and to garments obtainable from said textiles. In the present description textiles is used to define fibers, yarns and fabrics; preferably, the process of the invention is carried out on yarns and fabrics. Thus, according to an embodiment, the invention relates to a dyed textile comprising a dye and a plurality of carbon particles, wherein at least part of said carbon particles are 2D nanoparticles and/or 2D microparticles, preferably having the above mentioned dimensions.

In an embodiment, the dyed textile comprises an additional dye, different from 2D carbon nanoparticles and 2D carbon microparticles. A preferred additional dye is indigo, most preferably indigo is applied as a ring on the surface and the external portion of the section of the yarns of the textile product. The wording "indigo" here includes indigo derivatives; dyeing with indigo is known in the art and is not discussed in detail in this invention.

It was surprisingly found that carbon particles, in particular graphene and/or graphite 2D particles having dimensions as disclosed above, can provide an excellent undercoating, or basis, in the treated textile for a dye that is applied to the said textile; thus, the said undercoating may be used to achieve darker shades upon a further dyeing step with additional dyes, without changing the spectral response of the treated fabric. In other words, it is possible to use the carbon particles as a "foundation" onto which a different dye can be added: when a fabric, or textile, previously treated with carbon 2D particles according to the invention is dyed with a dye to impart e.g. color A, the fabric, or textile, exhibits shades of the same color A that are darker than the shades of A obtainable on the same fabric with the same amount of dye, when the undercoat of nanoparticles is not present. Nanoparticles of amorphous carbon, in particular those having dimensions in the range of 1 nm to 1000 nm, more preferably 1 to 800 nm, even more preferably 10 to 200 nm, proved to improve the undercoating effect when used in addition to an undercoating of 2D carbon nano- and/or micro-particles to dye the fabric, instead of using a dark or black dye; advantageously the nanoparticles of amorphous carbon may be used together with the 2D carbon nano- and micro-particles to provide the required dark colour by means of a single composition.

Thus, the invention provides on one side a process of dyeing a textile according to claim 1, wherein carbon 2D nano and/or microparticles are used. The process distinguishes from the prior art in that it uses 2D nano and/or microparticles, preferably 2D microparticles. According to an embodiment, the textile treated with a composition comprising nanoparticles of amorphous carbon and 2D carbon microparticles and/or nanoparticles, preferably microparticles, does not necessarily undergo a further dyeing treatment with a different, "traditional" dye. A further object of the invention is the use of carbon 2D micro and/or nanoparticles in a dyeing process, according to claim 16.

In another aspect, the invention provides for a dyeing process according to claim 3, comprising the step of preparing a composition containing 2D carbon particles, preferably 2D microparticles, as above described and applying said composition to textiles, characterized in that said textile is further treated with an additional dye which is different from 2D nanoparticles and 2D microparticles. In a further aspect, the invention relates to a composition, comprising carbon particles and at least a binder and/or an auxiliary chemical, said composition being configured to apply said carbon particles to a textile, characterized in that said carbon particles are 2D nanoparticles and/or 2D microparticles, preferably having dimensions of 0.01 to 150 microns, preferably of 0.1 to 20.0 microns, more preferably of 0.5 to 2 microns.

The compositions containing 2D carbon particles of the invention comprise 2D carbon particles, binders and auxiliary chemicals. Suitable binders are e.g. based on acrylate, styrene acrylate, styrene, acrylic ester, acrylonitrile. Suitable auxiliary chemicals are e.g. thickening agents, wetting agents, binders, softening agents and antifoaming agents. 2D carbon particles may be obtained from carbon sources such graphite, graphene and may be produced via mechanical and chemical exfoliation. Examples of compositions of amorphous carbon particles and relevant auxiliary chemicals are disclosed in US2003/0106160, to which reference is made for further details.

The carbon content of the composition applied on the yarn and/or fabric is in the range of 0.1 wt % to 30 wt %, preferably 1 wt % to 20 wt %, more preferably 5 wt % to 15 wt %. Textiles that may be treated with the invention process are mainly those from natural fibers, especially cellulose, regenerated cellulose, bamboo, kapok, hemp, flax, sisal etc. Additionally, synthetic fibers, yarns and/or fabrics made of polyethylene terephthalate, polyamides (incl. PA6, PA66, PA612, PA11), and mixtures thereof and mixtures natural and synthetic fibers, can benefit from such an undercoat as well.

The invention also provides several advantages over the prior art. In fact, by providing a 2D carbon particles undercoating in the external layer of the yarn, darker shades become accessible with very thin layer of coating without changing the mechanical features of the yarn and/or fabric, while allowing other chemicals like dyes to be bound to the textile for further applications, due to the inert character of the carbon to other chemicals. Summarizing, the carbon particles include 2D nanoparticles and/or 2D microparticles, advantageously having dimensions of 0.01 to 80 microns, preferably of 0.1 to 20.0 microns, more preferably of 0.5 to 2 microns; these carbon particles may be used as an undercoating for a dye; the dye may be a traditional dye, such as e.g. indigo, or other dye; the dye may be applied to the textile after having applied the undercoating.

The invention will now be further disclosed with reference to the following non-limiting examples and figures, in which.

As above mentioned, the invention process provides for preparing a composition containing carbon particles and treating a textile with the said composition; an additional step of dyeing the treated textile with an additional known dye suitable to be used with the said textile may also be provided by the invention method. The additional dyeing step is preferably performed on a textile treated with a composition comprising 2D nano- and/or micro-particles; a textile may also be treated with a composition comprising 2D nano- and/or micro-particles and other carbon particles, e.g. nanoparticles of amorphous carbon.

Preferably the textile is selected from yarns and fabrics, more preferably the textile is a yarn. Yarns may be treated with the invention compositions via rope dyeing process; the treated yarn may be subsequently be indigo dyed to obtain a ring-dye effect and may then be used to provide a fabric.

Figure 1:
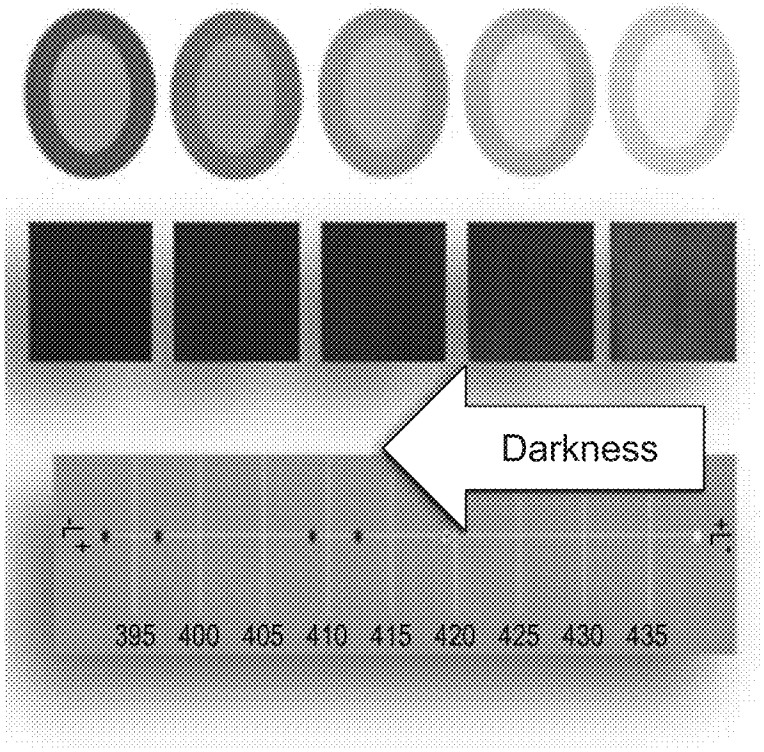
FIG. 1 is schematic illustration of the effect of successive treatments of a yarn with a composition of the invention.

By treating the textile with the invention compositions an undercoating layer is obtained, e.g. in the form of a "ring" of carbon particles, located essentially in the outer thickness, or outer layer, of the yarns, as shown in FIG. 1. FIG. 1 also shows the corresponding results of repeated treatment of the yarn or fabric with carbon particles compositions: darker shades of grey/black are progressively obtained. Undercoating of carbon particles is done preferably by dip dyeing process, which is known per se in the art.

Figure 2:
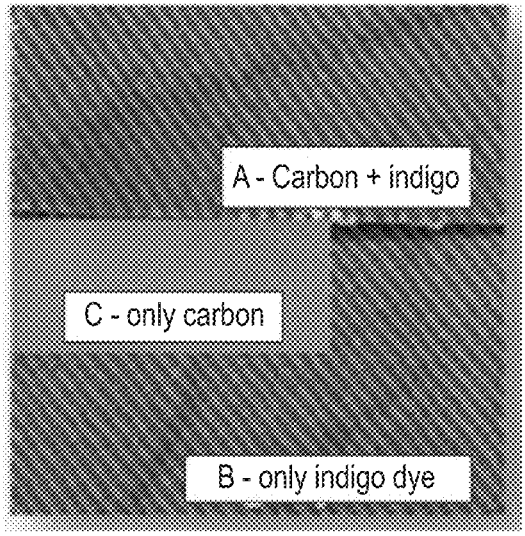
FIG. 2 is a picture of three fabrics, two according to the invention and one a comparative example.
Figure 3:
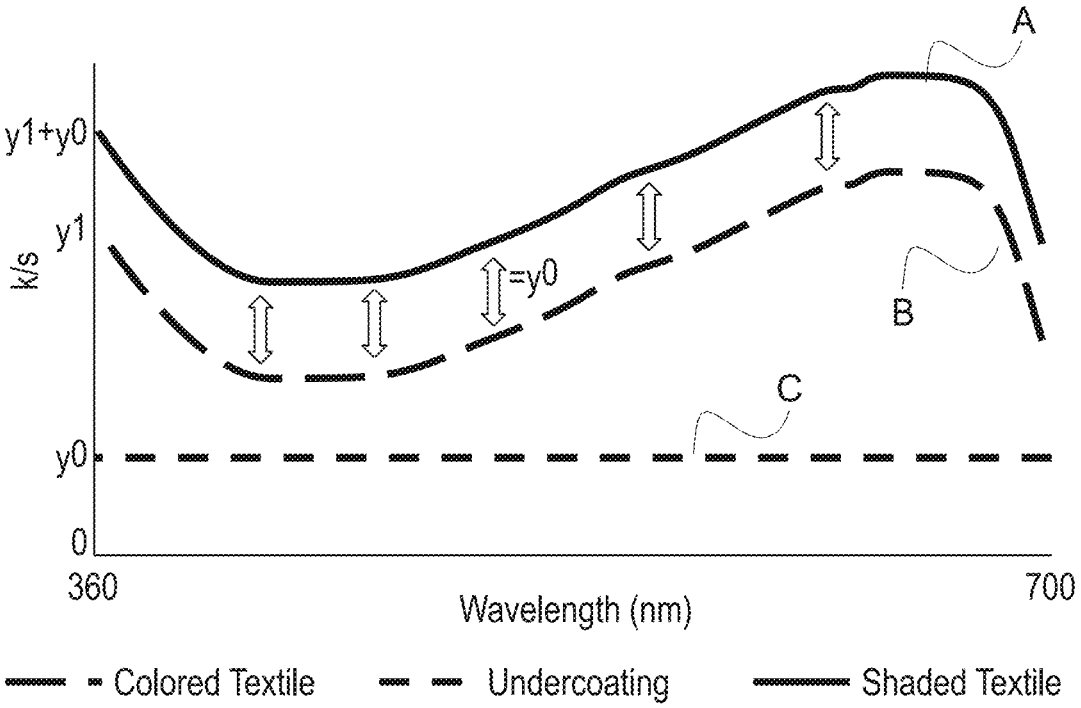
FIG. 3 is a graph showing the spectral definition of the fabrics of FIG. 2.

FIGS. 2 and 3 show a comparison between three different fabrics, i.e. fabrics A, B and C. Fabric A is a fabric dyed according to the invention process, by using a composition containing 2D carbon particles and by performing an additional dyeing step with indigo; fabric B is a fabric dyed only with indigo in a traditional way and fabric C is a fabric treated with only a composition according to the invention, without additional dye treatment. FIG. 3 shows the K/S readings of fabrics A-C obtained from Datacolor Spectrum Equipment (K/S is a function of frequency). The dotted line shows a K/S value of the ecru fabric C treated with a composition of carbon particles according to the invention.

It is noticed that the 2D carbon particles, particularly 2D microparticles, make the absorbance of the material nearly flat across the visible spectrum. Dashed line is the spectral response of fabric B, i.e. of an ordinary indigo dyeing on the ecru fabric; the continuous line shows the K/S values of fabric A, i.e. the fabric where the ecru fabric C first undercoated with the carbon source has been then dyed with indigo. As a result of the flat absorbance of the undercoat, darker shade is achieved without changing the spectral response of the desired colour and without using higher concentrations of the dye itself (in this case of indigo) as otherwise would be necessary if a traditional dyeing system and process is used.

Figure 4:
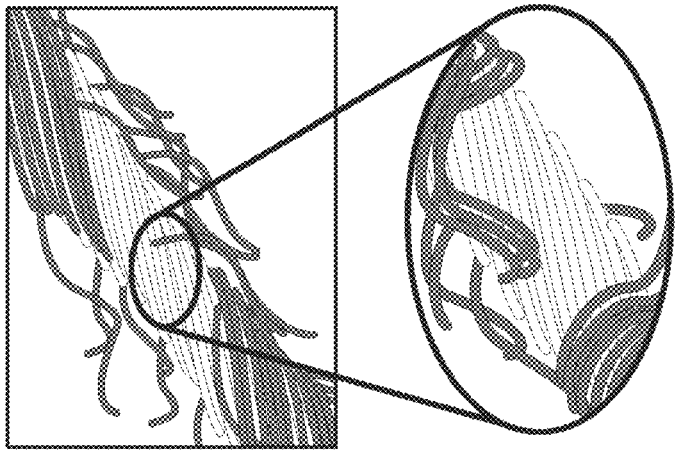
FIG. 4 is a picture of an untwisted yarn showing how the ring effect is maintained in the process of the invention.

FIG. 4 schematically shows the ring effect obtainable with the process of the invention on a yarn treated with carbon 2D particles and further dyed with indigo. The picture shows a partially un-twisted carbon+indigo dyed yarn in which the dyed outer fibers and the white inner core are well visible. Thanks to the enhanced ring dyeing effect obtainable according to the invention, a fabric according to the invention can provide a wider variety of effects than known fabrics, upon washes and other known finishing treatments, including rinse wash, enzyme wash and stone wash.

EXAMPLE 1

Five fabrics were subjected to consecutive dip-dry treatment by a composition of the invention to provide different undercoatings of carbon particles, namely graphene particles. Undercoating of carbon particles was done by dipping-drying method. Concentration of graphene in the composition was 3.7 g/L. Indigo concentration in a formulation which was used as a top (i.e. additional) dye was 1.10% by weight of the indigo containing formulation.

The graphene particles were 2D nano- and microparticles having dimension in a range of 0.5-2.0 microns. Graphene composition was water based; in addition to the nano- and micro-particles the composition included 2 g/L emulsifying agent, 10 g/L binder, 5 g/L of thickening agents, 5 g/L of wetting agents, 20 g/L of softening agents and 0.5 g/L of antifoaming agents.

All the samples were treated in the same graphene particles composition; fabric sample #1 was dipped-dried only once while sample #2 is dipped-dried twice, sample #3 was treated three times, sample #4 four times and sample #5 five times.

All the five samples were subsequently dyed with the same indigo dyeing treatment, which is also carried out onto an untreated fabric (reference fabric). Absolute L* values (detected with Datacolor spectrophotometer measurements) were obtained: each dip-dry treatment gives darker shades to the fabrics by each consecutive treatment, with the reference having an L* value of 25.9 and samples 1-5 having L* values decreasing from 25.0 to 23.8.

Figure 5:
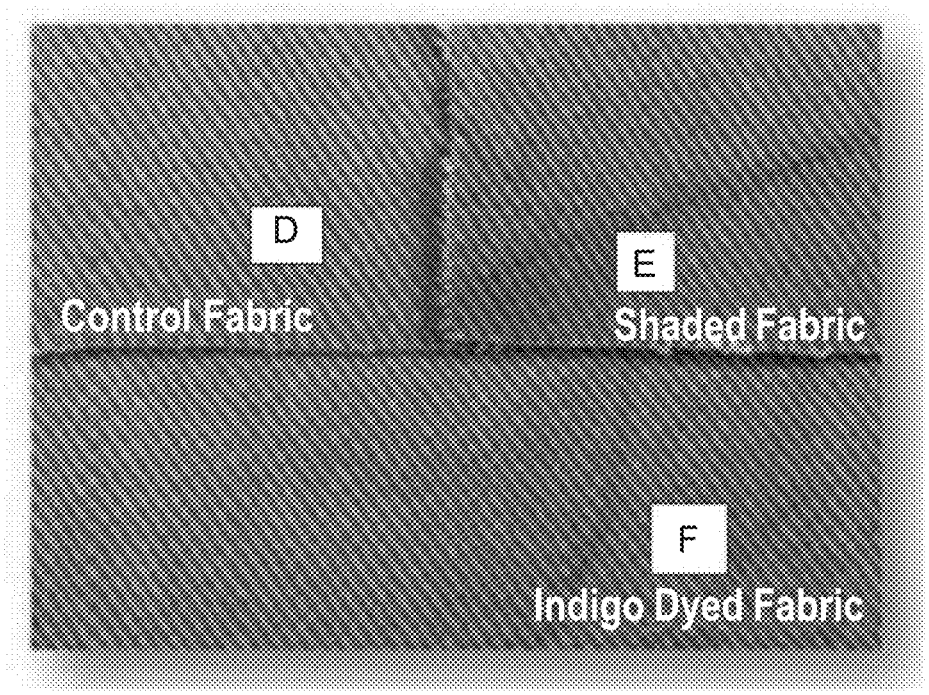
FIG. 5 is a picture of a fabric according to the invention vs. two control fabrics.

FIG. 5 shows the picture of three fabrics including indigo dyed fabric F as a reference, fabric F was obtained by indigo dyeing the fabric, without any previous treatment. Fabric E is a fabric treated according to the invention, i.e. a fabric having an undercoating with graphene 2D particles as disclosed in the present example and indigo dyed; control fabric D was treated to provide an undercoating for indigo with other chemicals, namely auxiliary chemicals (wetting agent, softening agent etc.), excluding carbon particles.

Figure 6:
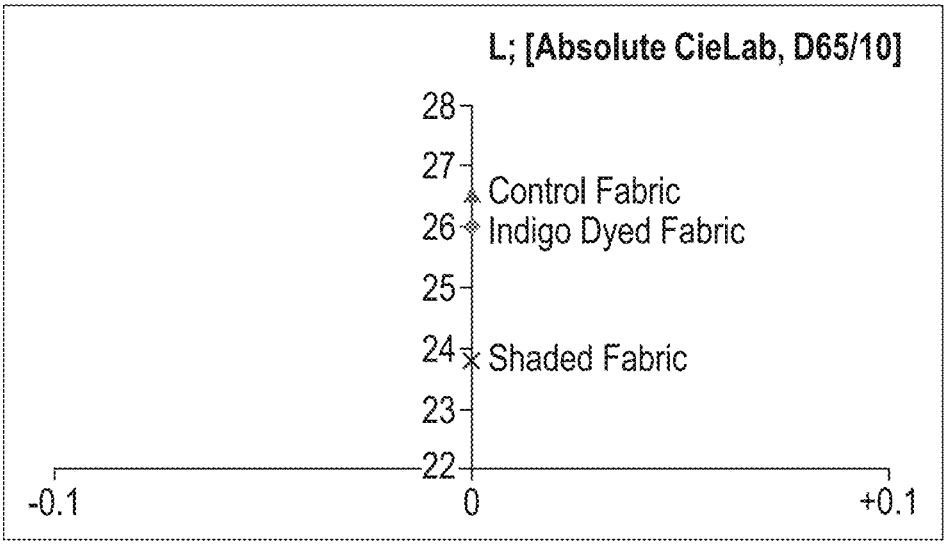
FIG. 6 is a graph showing the lightness values of the three fabrics of FIG. 5.

Lightness (L) values, visible in FIG. 6, also show that a darker shade of the fabric is deriving from the presence of the carbon source. Shaded fabric (E) is 8.4% darker than the reference indigo dyed fabric (F) while control fabric (D) is 2.2% lighter than the reference.

From the above it is clear that the use of 2D carbon microparticles and nanoparticles (the 2D particles having a preferred range of dimensions of 0.5 to 2.0 microns—i.e. 500 nanometres to 2.0 microns) to treat a textile in a dyeing process before applying a dye, provides several advantages to the process. Namely, it results in lower consumption of dye and water and chemicals used in the dye process because of the colour basis, or undercoating, that is provided by the 2D carbon nano- and/or microparticles. At the same time, the final colour of the textile is not jeopardized by the use of the carbon particles of the invention.

The invention claimed is:

1. A process of dyeing a textile, comprising the step of preparing a composition containing carbon particles and applying said composition to textiles, characterized in that at least part of said carbon particles are carbon nanoparticles and/or carbon microparticles having a thickness in nanometers and having a length of the major axis comprised in the range of 0.01 to 80 microns.

2. A process according to claim 1, wherein said carbon particles have dimensions of 0.1 to 20 microns.

3. A process according to claim 1, further comprising the step of dyeing said textile with at least one additional dye which is different from said carbon nanoparticles and said carbon microparticles.

4. A process according to claim 3, wherein said dye contains indigo or an indigo derivative which is applied to said textile, with a rope-dyeing process when said textile is a yarn and a dyeing process when said textile is a fabric.

5. A process according to claim 1, wherein said composition containing carbon particles is applied more than once to said textiles.

6. A process according to claim 1, wherein said textile is selected from yarns and fabrics.

7. A process according to claim 6, further comprising the step of treating said fabric in a finishing step to remove part of at least said additional dye.

8. A process according to claim 1, wherein said carbon particles are selected from graphene, graphite and mixtures thereof.

9. A dyed textile as obtainable according to the process of claim 1, comprising a plurality of carbon nanoparticles and/or carbon microparticles having a thickness in nanometers and having a length of the major axis comprised in the range of 0.01 to 80 microns.

10. A dyed textile according to claim 9 further comprising an additional dye, different from carbon particles.

11. A dyed textile according to claim 10, wherein said additional dye comprises indigo or an indigo derivative.

12. A dyed textile according to claim 11, wherein at least said textile is ring-dyed.

13. A garment comprising a textile according to claim 10.

14. A garment according to claim 13, wherein part of the additional dye or of said additional dye and of said carbon particles has been removed from the textile.

15. A composition for a process of dyeing a textile according to claim 1, comprising carbon particles and at least a binder and/or an auxiliary chemical, said composition being configured to apply said carbon particles to a textile, characterized in that said carbon particles are carbon nanoparticles and/or carbon microparticles having a thickness in nanometers and having a length of the major axis comprised in the range of 0.01 to 80 microns.

16. A method for dyeing a textile with carbon nano or microparticles to provide an undercoating for the application of a dye, said carbon nano or microparticles having a thickness in nanometers and having a length of the major axis comprised in the range of 0.01 to 80 microns.

* * * * *